United States Patent [19]

Saito et al.

[11] 4,197,279

[45] Apr. 8, 1980

[54] CARBON FIBER HAVING IMPROVED THERMAL OXIDATION RESISTANCE AND PROCESS FOR PRODUCING SAME

[75] Inventors: Kazuhisa Saito, Mishima; Yasuo Kogo, Shizuoka, both of Japan

[73] Assignee: Toho Beslon Co., Ltd., Tokyo, Japan

[21] Appl. No.: 934,655

[22] Filed: Aug. 17, 1978

[30] Foreign Application Priority Data

Aug. 17, 1977 [JP] Japan ..... 52/97757

[51] Int. Cl.[2] ..... D01F 9/12

[52] U.S. Cl. ..... 423/265; 106/307; 264/29.2; 423/275; 423/447.1; 423/447.5

[58] Field of Search ..... 423/447.5, 447.1, 447.2, 423/447.4, 447.7, 265, 275; 264/29.2; 106/292, 306, 307, 56; 427/227, 228

[56] References Cited

U.S. PATENT DOCUMENTS 4,002,426 1/1977 Chenevey et al. ..... 423/447.5 X 4,126,652 11/1978 Oohara et al. ..... 423/447.5 X

*Primary Examiner*—Edward J. Meros

*Attorney, Agent, or Firm*—Sughrue, Rothwell, Mion, Zinn and Macpeak

[57] ABSTRACT

An acrylic carbon fiber with excellent thermal oxidation resistance, which contains 50 ppm or more of a phosphorus component (as phosphorus) and/or a boron component (as boron) and which contains 100 ppm or more of a zinc component (as zinc) and/or a calcium component (as calcium), and which suffers a fiber weight reduction of about 20% or less upon standing for 3 hours in air at 500° C.

33 Claims, 1 Drawing Figure

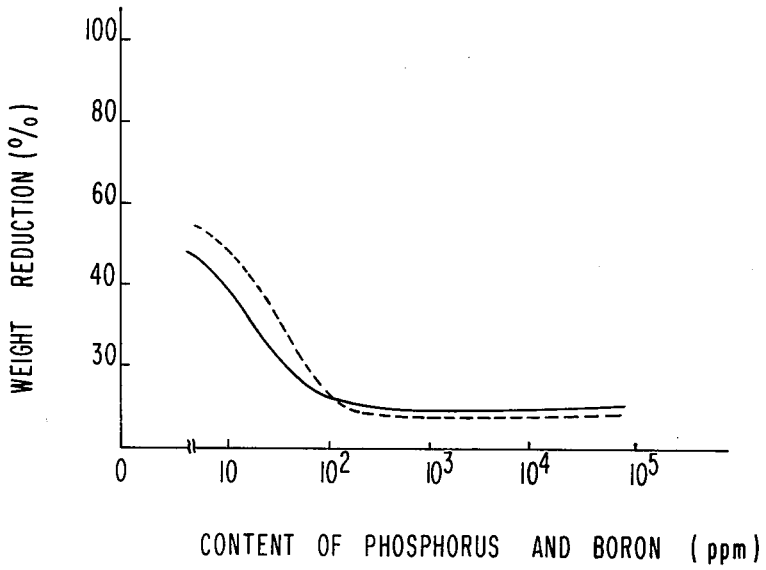
100
80
60
40
30
WEIGHT REDUCTION (%)
0
10
10²
10³
10⁴
10⁵
CONTENT OF PHOSPHORUS AND BORON (ppm)

CARBON FIBER HAVING IMPROVED THERMAL OXIDATION RESISTANCE AND PROCESS FOR PRODUCING SAME

BACKGROUND OF THE INVENTION

1. Field of the Invention

This invention relates to a carbon fiber with high performance characteristics and excellent thermal oxidation resistance produced from an acrylic fiber.

2. Description of the Prior Art

Carbon fibers have recently attracted attention as a reinforcing material for various composite materials due to their extremely high specific strength and specific modulus of elasticity, and have been employed in materials for aircraft and spacecraft, materials for sports equipment and materials for industrial uses. In addition, the characteristic properties of heat resistance, chemical resistance, abrasion resistance and electric conductivity as well as the above-described properties enable carbon fibers to be utilized for a wide variety of uses.

In using carbon fibers particularly for materials such as materials for high temperature furnaces, filter media, carbon fiber-reinforced plastics, carbon fiber-reinforced carbons, carbon fiber-reinforced metals, etc., oxidation resistance at high temperatures is a significant property when the molding steps and use conditions are taken into consideration.

Many techniques have so far been proposed including those disclosed in Japanese Patent Publication No. 4,405/62, and U.S. Pat. Nos. 3,285,696 and 3,412,062 for the production of carbon fibers. However, many commercially available carbon fibers have such poor thermal oxidation resistance that they are completely ashed by, for example, mere contact with air at 500° C. for about 3 hours.

It has now been discovered that the thermal oxidation resistance can remarkably be improved if a phosphorus component and/or a boron component, and a zinc component and/or a calcium component is present in the carbon fiber in slight amounts.

An acrylic fiber containing phosphorus and sodium or potassium prepared by treating the acrylic fiber with a phosphorus compound and a sodium or potassium compound has heretofore been proposed for use as a starting material, thereby to facilitate preoxidation and carbonizing (e.g., as disclosed in Japanese Patent Publication No. 42,813/73 and British Pat. No. 1,214,807).

However, it has now been confirmed that the thus obtained carbon fiber containing phosphorus and an alkali metal such as sodium or potassium has an extremely low thermal oxidation resistance.

SUMMARY OF THE INVENTION

An object of the present invention is to provide a carbon fiber having high strength, in particular a carbon fiber having an improved thermal oxidation resistance produced from an acrylic fiber, and a process for producing the same.

Another object of the present invention is to provide an acrylic carbon fiber having an improved thermal oxidation resistance, which suffers a weight reduction of about 20% or less on standing for 3 hours in air at 500° C., and a process for producing the same.

The present invention in one embodiment provides an acrylic carbon fiber containing 50 ppm or more of a phosphorus component (as phosphorus) and/or a boron component (as boron) and containing 100 ppm or more of a zinc component (as zinc) and/or a calcium component (as calcium).

In another embodiment, this invention provides a process for producing an acrylic carbon fiber as described above which comprises producing an acrylonitrile polymer from a monomer solution containing at least acrylonitrile, spinning the acrylonitrile polymer to produce an acrylonitrile fiber, preoxidizing the acrylonitrile fiber to produce a preoxidized fiber and then carbonizing the fiber to produce a carbon fiber and further incorporating or depositing (1) a phosphorus compound, a boron compound or a mixture thereof and (2) a zinc compound, a calcium compound or a mixture thereof in or on the acrylic fiber, the preoxidized fiber or the carbon fiber during the process such that the carbon fiber ultimately contains 50 ppm or more of a phosphorus component, a boron component or a mixture thereof and 100 ppm or more of a zinc component, a calcium component or a mixture thereof.

BRIEF DESCRIPTION OF THE DRAWING

The FIGURE is a graph showing influences of the amount of phosphorus and boron in a carbon fiber on the thermal oxidation resistance wherein the solid line shows the influence of phosphorus, and the broken line shows the influence of boron.

DETAILED DESCRIPTION OF THE INVENTION

The acrylic fiber used as the starting material in the present invention can be a homopolymer of or a copolymer of acrylonitrile with another monomer copolymerizable therewith or a mixture of these homopolymers and copolymers. Suitable comonomers which can be used include alkyl acrylates (such as methyl acrylate, ethyl acrylate and butyl acrylate), alkyl methacrylates (such as methyl methacrylate, ethyl methacrylate and butyl methacrylate), vinyl acetate, acrylamide, N-methylolacrylamide, acrylic acid and the metal salts thereof, vinylsulfonic acid and the metal salts thereof, allylsulfonic acid and the metal salts thereof, etc. Suitable metal salts include salts of alkali metals such as sodium or potassium, salts of alkaline earth metals such as calcium or magnesium, salts of zinc family metals such as zinc or cadmium, and the like. In using a salt of zinc or calcium, the salt remains in the acrylic fiber and it acts as a zinc component or a calcium component which improves the thermal oxidation resistance of the carbon fiber obtained from the acrylic fiber. When sodium or potassium salts are used they are removed after spinning by washing with water or by ion exchange with zinc ions or calcium ions. The content of sodium and potassium in the fiber should be less than 100 ppm (calculated as sodium metal or potassium metal). An acrylic fiber containing about 90 weight % or more of acrylonitrile is preferred to obtain a carbon fiber having excellent mechanical properties. Hereinafter, the term acrylic polymer will be used to describe both homopolymers and copolymers of acrylonitrile as described above.

A suitable molecular weight of the acrylic polymer generally ranges from about 50,000 to about 150,000, and acrylic fibers produced from them in a conventionally known process can be used.

These acrylic polymers can be produced using hitherto known method, for example, suspension polymerization or emulsion polymerization in an aqueous system, or solution polymerization in a solvent. These methods are described in, for example, U.S. Pat. Nos. 3,208,962, 3,287,307 and 3,479,312.

Spinning of the acrylonitrile based polymer can be carried out by hitherto known methods. Examples of spinning solvents which can be used include inorganic solvents such as a concentrated solution of zinc chloride in water, concentrated nitric acid and the like, and organic solvents such as dimethylformamide, dimethylacetamide, dimethyl sulfoxide, and the like. Examples of spinning methods which can be used are dry spinning and wet spinning. In wet spinning, in general, steps such as coagulation, water-washing, stretching, shrinking (if necessary), drying and the like are suitably combined. These spinning methods are described in U.S. Pat. Nos. 3,135,812 and 3,097,053.

This stretching is carried out to the same extent as in a usual acrylic fiber, and a suitable degree of stretching is generally about 5 to about 30 times the original length.

For example, acrylic fibers can be produced using a continuous method comprising preparing a reaction mixture by dissolving a monomer or monomers as described above and a polymerization catalyst into an aqueous solution of zinc chloride, polymerizing the monomer or monomers then spinning the acrylic polymer produced and stretching the thus obtained acrylic fibers.

The acrylic fiber can be subjected to conventionally known processing to obtain the acrylic carbon fiber of the present invention, that is, the acrylic carbon fiber can be obtained by preoxidation in an oxidizing atmosphere preferably containing more than 15 vol % oxygen, such as air, at about 200° to 300° C. for about 0.5 to about 5 hours, and then carbonizing the preoxidized acrylic carbon fiber in an inert gas atmosphere, for example, nitrogen or argon, or in a vacuum (such that the oxygen content is less than 100 ppm, preferably less than 30 ppm) at about 500° to about 2,000° C. for about 5 minutes to about 1 hour.

The preoxidized fiber to be used here preferably contains about 8 to about 15 weight % of bonded oxygen. If the amount of bonded oxygen is less than about 8 weight %, insufficient preoxidation occurs, whereas if the amount of bonded oxygen is more than about 15 weight %, excess preoxidation occurs. When such fibers are carbonized, the resulting carbon fibers are fragile and show poor mechanical properties. However, the effect of improving the thermal oxidation resistance of the carbon fiber can also be obtained in such cases.

The thickness of the carbon fibers of the present invention is not particularly limited but, in general, fibers of a thickness of about 5 to about 20$\mu$ are used.

Acrylic carbon fibers which are employed in actual use usually have a strength of more than 3 g/d, preferably more than 5 g/d and a ductility of 5 to 25%, preferably 8 to 15%. The acrylic carbon fiber of this invention which contains a phosphorus component and/or a boron component, and a zinc component and/or a calcium component has excellent thermal oxidation resistance without any of above-described properties deteriorating.

The carbon fibers of the present invention can be produced by incorporating the component described above into the fibers (i.e., into the acrylic fibers, into the preoxidized fibers, or into the carbon fibers produced) or depositing the components onto the surface of the fibers in a single step or in two or more steps in at least one point during the process of preparing a reaction mixture for producing a polymer for an acrylic fiber and the process of producing the carbon fibers, i.e., in one or two or more of the carbon fiber production steps and between any two of the carbon fiber production steps; or after any step in the sequence of carbon fiber production steps. These steps include the preparation of the above-described reaction mixture for producing the acrylic polymer, the production of the acrylic fiber, the acrylic fiber after production, the preoxidation step to produce the preoxidized fiber and the carbonizing step to produce the carbon fiber. The compounds may be incorporated in or deposited on the fibers in any order.

The carbon fiber of the present invention can be produced, for example, using one of the three processes described below.

One process comprises incorporating or depositing at least one of a phosphorus compound and a boron compound and at least one of a zinc compound and a calcium compound into the acrylic fibers or onto the surface of the acrylic fibers. More specifically, the process comprises mixing these compounds into the above-described reaction mixture to produce the acrylic polymer or the acrylic polymer solution before spinning or by treating the acrylic fibers with a solution containing these compounds during spinning or washing or in a subsequent after-treatment.

In adding these compounds to the above-described reaction mixture to produce the acrylic polymer or to a solution of the acrylic polymer before spinning, they can be added in desired amounts as an aqueous or organic solution thereof or as an aqueous or organic dispersion thereof. On the other hand, in treating the fibers produced with a solution or a dispersion containing these compounds, the fibers are generally immersed in an aqueous or organic solution thereof or in an aqueous or organic dispersion thereof of a concentration of about 0.01 to 10 weight % for about 10 seconds to about 20 minutes or such a solution or dispersion thereof is sprayed onto the fibers to deposit the solution or dispersion thereof onto the fiber surface or to impregnate the solution or the dispersion thereof into the fibers. The necessary amount of the compound deposited on or impregnated in the fibers can be determined by simple calculations. However, when the nature of the compounds changes or appears to change during preoxidation or carbonization the amount can only be determined by testing. The thus deposited solution or dispersion may be dried. Drying is generally conducted at a temperature of about 80° to about 150° C. After drying, the fibers are subjected to the preoxidation, followed by the carbonizing treatment.

The second process comprises incorporating or depositing at least one of the compounds in or on the acrylic fibers during or after the acrylic fibers have been produced but before preoxidation and, after preoxidation, depositing the necessary remaining compound or compounds, and then subjecting the thus-treated fibers to the carbonizing treatment. For example, acrylic fibers in or on which the zinc compound or the calcium compound or both of the zinc compound and the calcium compound have been incorporated or deposited according to the first process are subjected to preoxidation, and the phosphorus compound or the boron compound or both of the phosphorus compound and the boron compound are deposited on the preoxidized fibers by treating the fibers with a solution or dispersion containing the phosphorus and/or boron compound in a manner as described above. Subsequently, the treated fibers are carbonized.

The third process comprises incorporating or depositing at least one of the compounds in or on the acrylic fibers during or after the production of the acrylic fibers and before preoxidation, and then preoxidizing and carbonizing the fibers. The thus obtained carbon fibers are then treated with a solution or dispersion containing the necessary remaining compound or compounds. For example, the process comprises incorporating or depositing the zinc compound and/or the calcium compound in or on the acrylic fibers using the first process described above, preoxidizing the resulting acrylic fibers, and then carbonizing the fibers. The thus-obtained carbon fibers are then treated with a solution or a dispersion containing the phosphorus compound and/or boron compound in a manner as described above.

It is needless to say that the treatment with the zinc compound and/or the calcium compound and the treatment with the phosphorus compound and/or the boron compound may be conducted at the same time using a mixture containing all of the necessary compounds at any step in or after production of the carbon fibers.

When an acrylic polymer is produced in an aqueous solution containing zinc chloride, usually, the acrylic carbon fiber produced from the polymer contains more than 100 ppm of the zinc component. However, if the zinc component is reduced to less than 100 ppm in subsequent processing, e.g., during washing by water, additional zinc component should be added at some step during the production of the carbon fiber.

Suitable phosphorus compounds which can be used in the present invention include phosphoric acids (e.g., orthophosphoric acid, polyphosphoric acid, metaphosphoric acid, etc.), phosphoric acid salts of metals of groups Ib (e.g., Cu, Ag and Au), IIa (e.g., Mg, Ca, Sr and Ba), IIb (e.g., Zn, Cd and Hg), IIIa (e.g. Al, Ga, In and Tl), IIIb (e.g., Sc and Y), IVa (e.g., Sn and Pb), IVb (e.g., Ti, Zr, Hf and Th), Va (e.g., Sb and Bi), Vb (e.g., V, Nb and Ta), VIa (e.g., Se, Te and Po), VIb (e.g., Cr, Mo, W and U), VIIb (e.g., Mn and Tc) and VIII (e.g., Fe, Co, Ni, Ru, Rh, Pd, Os, Ir and Pt) of the Periodic Table (e.g., calcium phosphate, zinc phosphate, copper phosphate, calcium hydrogen phosphate, thorium phosphate, lead phosphate, nickel phosphate, hafnium phosphate, zirconium phosphate, bismuth phosphate, uranium phosphate, chromium phosphate and cerium phosphate, etc., excluding alkali metal salts such as sodium or potassium salts), phosphoric esters (including meta- and ortho-) (e.g., tricresyl phosphate, diphenylcresyl phosphate, methyl phosphate, ethyl phosphate, propyl phosphate, butyl phosphate, glucose-1-phosphoric acid, and glucose-6-phosphoric acid).

Suitable boron compounds which can be used include boric acids (e.g., boric acid, metaboric acid, hypoboric acid, etc.), boric acid salts of the above-described metals of the Periodic Table (e.g., calcium borate, copper borate, zinc borate, cadmium borate, manganese borate, lead borate, nickel borate, barium borate, etc. excluding alkali metal salts such as sodium or potassium salts), and boric esters (e.g., such as methyl borate, ethyl borate, propyl borate, butyl borate and phenyl borate), etc.

Suitable zinc compounds which can be used in the present invention include zinc chloride, zinc oxide, zinc sulfate, zinc hydroxide, zinc carbonate, barium zincate, zinc bromide, zinc iodide, etc.

Suitable calcium compounds which can be used in the present invention include calcium oxide, calcium peroxide, calcium hydroxide, calcium chloride, calcium sulfate, calcium nitrate, calcium iodide, calcium bromide, etc.

When one of the compounds contains more than one of the essential components used in this invention, such as zinc phosphate, it may be necessary to use only one compound to provide both of the essential components, as long as the amounts of each of the components are within the range set forth above.

The actual nature or form of the phosphorus component, the boron component, the zinc component and the calcium component present in the carbon fiber of this invention after the carbonizing treatment is not at present completely clear. However, as long as the components exist in the carbon fiber or on the carbon fiber ultimately produced regardless of their actual state or form, the thermal oxidation resistance of the fiber is markedly improved. Any compound containing the phosphorus component, the boron component, the zinc component or the calcium component can be used in the present invention if the component remains in or on the carbon fiber ultimately obtained.

These compounds can be used by dissolving or dispersing them into water or into an organic liquid medium such as an alcohol (e.g., methyl alcohol and ethyl alcohol) and a ketone (e.g., acetone and methyl ethyl ketone).

When acrylic fibers are treated with an organic solution or suspension, the organic medium should be those which do not dissolve the fibers. When the treatment is carried out before carbonization, the organic medium should be capable of being removed before the fiber is subjected to carbonization. Any organic medium can be used as long as it satisfies the above-described requirements.

When the acrylic fiber is produced from a copolymer including a monomer of a zinc or calcium salt, such is used to prepare a carbon fiber and a zinc or calcium component remains in the carbon fiber in an amount of 100 ppm or more, a zinc or calcium compound does not need to be added additionally.

The carbon fiber of the present invention having high strength shows an extremely excellent thermal oxidation resistance.

The influence of incorporating metal components in carbon fibers on the thermal oxidation resistance of the carbon fibers are tabulated in Table 1 below.

Table 1

| Run No. | Metal Component Present in Carbon Fiber (ppm) | | | | | | Thermal Oxidation Resistance of Carbon Fiber* | |
|---|---|---|---|---|---|---|---|---|
| | Na | K | Zn | Ca | P | B | Weight Reduction (%) | State of Carbon Fiber |
| 1 | 1500 | — | — | — | — | — | 99.5 | Ashing occurred, fibrous shape not retained |

Table 1-continued

| Run No. | Metal Component Present in Carbon Fiber (ppm) Na | K | Zn | Ca | P | B | Thermal Oxidation Resistance of Carbon Fiber* Weight Reduction | State of Carbon Fiber |
|---|---|---|---|---|---|---|---|---|
| 2 | 1800 | — | — | — | 1500 | — | 80.0 | Retained fibrous shape but mechanical properties were bad |
| 3 | — | 2000 | — | — | — | — | 98.9 | Ashing occurred, fibrous shape not retained |
| 4 | — | — | 1100 | — | — | — | 57.5 | Retained fibrous shape but mechanical properties were bad |
| 5 | — | — | 1000 | — | 1100 | — | 11.3 | Maintained strength and modulus of elasticity |
| 6 | — | — | — | 1500 | — | — | 59.4 | Retained fibrous shape but mechanical properties were bad |
| 7 | — | — | 1000 | — | — | 1500 | 8.6 | Maintained performance characteristics |
| 8 | — | — | 800 | — | 500 | — | 9.8 | Maintained performance characteristics |
| 9 | — | — | — | 3900 | 5100 | — | 10.5 | Maintained performance characteristics |
| 10 | — | — | 1100 | — | 900 | 600 | 9.5 | Maintained performance characteristics |
| 11 | — | — | 800 | 1100 | 1300 | — | 9.9 | Maintained performance characteristics |
| 12 | 800 | — | 1300 | — | 1100 | — | 75.5 | Retained fibrous shape but mechanical properties were bad |
| 13 | 50 | — | 1200 | — | 1400 | — | 15.3 | Maintained performance characteristics |

*Treated for three hours in air at 500° C.

Run Nos. 5, 7, 8, 9, 10, 11 and 13 were in accordance with the present invention. The term "performance characteristics" means the mechanical properties as shown in Table 2 hereinafter.

The influence of incorporating the metal components in the carbon fiber is not affected by the method used for incorporating the metal components. Fibers of Run Nos. 1 and 2 are usually produced using an acrylic polymer, as a starting material, which contains a comonomer containing sodium or potassium, or produced using a polymerization catalyst containing sodium or potassium in the polymerization reaction.

The influence of the phosphorus component and the boron component in the carbon fiber on thermal oxidation resistance are as shown in the FIGURE, wherein the solid line shows the relationship between the phosphorus content and the weight reduction ratio, and the broken line shows the relationship between the boron content and the weight reduction ratio.

In this case, the zinc component was present in the carbon fiber in an amount of 1000 ppm. Substantially the same results were obtained when a calcium component was used instead of a zinc component.

The heat resistance of composite materials obtained by using the carbon fibers of the present invention as a reinforcing material and a polyimide resin as a matrix are tabulated in Table 2 below.

This table shows that the mechanical properties and heat resistance of composite materials using the carbon fiber of the present invention with an excellent thermal oxidation resistance as a reinforcing agent are superior to those using the carbon fiber prepared in the same manner except that no phosphorus was present.

Table 2

| Carbon Fiber | High Temperature Exposure Conditions | Measured Temperature (°C.) | *1 | *2 | *3 | *4 | *5 |
|---|---|---|---|---|---|---|---|
| Carbon Fiber* | | | | | | | |
| | — | 27 | 142 | 11.3 | 7.7 | 1300 | 800 |
| | — | 320 | 75.2 | 11.0 | 4.6 | 1300 | 800 |
| | 500 hrs in air at 320° C. | 320 | 94.5 | 10.7 | 4.5 | 1300 | 800 |
| Carbon Fiber** | | | | | | | |
| | — | 27 | 139 | 11.4 | 7.8 | 1100 | — |
| | — | 320 | 60.9 | 10.1 | 4.3 | 1100 | — |
| | 500 hrs in air at 320° C. | 320 | 73.3 | 9.5 | 4.1 | 1100 | — |

*Carbon fiber of the invention.
**Carbon fiber with high strength having inferior thermal oxidation resistance.
*1 Bending strength (kg/mm$^2$)
*2 Bending modulus (ton/mm$^2$)
*3 Interlaminar shearing strength (kg/mm$^2$)
*4 Zn content in carbon fiber (ppm)
*5 P content in carbon fiber (ppm)

Bending strength and bending modulus were measured using the 3-point bending method where l/d was 32 in which l was the distance between the two fulcra on a test piece and d was the thickness of the test piece.

Interlaminar shearing strength was measured using the short beam method where l/d was 4.

Note 1. The polyimide resin used as a matrix was NR-150B2, made by E. I. du Pont de Nemours & Co. Inc.

Note 2. Volume contents of carbon fiber in the composite materials were 60–62%.

The results in Table 1, the FIGURE and Table 2 illustrate the effects of the present invention. As is clear from the results in Table 1, oxidative decomposition of carbon fibers containing sodium or potassium (Run Nos. 1–3) occurred when the fibers were heat-treated for 3 hours in air at 500° C. resulting in complete ashing or, where the fibrous shape was retained, a serious deterioration of the performance characteristics occurred. In contrast, an extremely excellent thermal oxidation resistance was obtained in Run Nos. 5, 7, 8, 9, 10, 11 and 13 using carbon fibers in accordance with the present invention. The results in the FIGURE show the influence of the amount of the phosphorus component and the boron component on the thermal oxidation resistance. Incorporation of a slight amount of the phosphorus or boron component serves to markedly improve the thermal oxidation resistance and, when the amount of such component reaches 50 ppm or more, the weight reduction ratio of the carbon fiber becomes as low as 20% or less even upon heat-treatment for 3 hours in air at 500° C. When the amount of at least one of the zinc component and the calcium component reaches 5000 ppm and the amount of at least one of the phosphorus and boron component reaches 1000 ppm, the influence thereof on the thermal oxidation resistance levels off. More specifically, although at least one of the zinc component and the calcium component may be incorporated in an amount of more than 5000 ppm and at least one of the phosphorus component and the boron component may be incorporated in an amount of more than 1000 ppm, sufficient effects can be obtained by incorporating these components in amounts of 100 to 5000 ppm and 50 to 1000 ppm, respectively.

As described above, the carbon fiber of the present invention has excellent thermal oxidation resistance and, when used in composite materials, the carbon fiber of the present invention maintains excellent property and provides excellent composite materials.

The following examples are given to illustrate the present invention in greater detail. Unless otherwise indicated, all parts, percents, ratios and the like are by weight.

EXAMPLE 1

9.6 parts by weight of acrylonitrile, 0.3 parts by weight of methyl acrylate and 0.1 parts by weight of sodium allylsulfonate, 0.01 parts by weight of sodium persulfate and 0.02 parts by weight of sodium bisulfate were dissolved in 90 parts by weight of a 60 weight % zinc chloride aqueous solution to obtain 10 weight % of a monomer solution, and polymerization was conducted to produce a copolymer (molecular weight 100,000). Subsequently, the copolymer was spun into fibers and washed with water. After stretching the fibers (stretched 7 times the original length during coagulation and washing, and stretched 5 times the length of the fibers after the initial stretching), the fibers were immersed in a 0.1 weight % phosphoric acid aqueous solution for 1 minute and dried at 120° C. for 30 minutes to obtain treated fibers. Then, these treated fibers were subjected to preoxidation for 150 minutes at 260° C. in air. The resulting preoxidized fibers contained 11.3 weight % of bonded oxygen. Subsequently, the fibers were continuously treated in a nitrogen stream at 850° C. for 5 minutes, then at 1300° C. for 15 minutes to produce carbon fibers. The thus-obtained carbon fibers contained 800 ppm of the zinc component and 500 ppm of the phosphorus component, and no sodium and potassium were detected. The fiber performance characteristics of the carbon fibers were measured according to the strand method, described below, to obtain a strength of 295 kg/mm$^2$ and a modulus of elasticity of $24.3\times10^3$ kg/mm$^2$. The weight reduction ratio of the fibers when heat-treated for 3 hours at 500° C. in air was measured and found to be 9.8% by thermogravimetric analysis.

Strand Method:

(1) A carbon fiber strand was impregnated with a resin and the resin was hardened under a tension so that the strand was not loosened to obtain a test piece.
(2) The test piece obtained in (1) was set on a Instron universal tester and an extensometer was set on the test piece. A tensile load was applied to the test piece.
(3) Elongation and breaking load were measured.
(4) The cross section of the fiber was calculated.
(5) Strength and modulus of elasticity were obtained from (3) and (4) above.

EXAMPLE 2

9.8 parts by weight of acrylonitrile, 0.2 parts by weight of methyl acrylate, 0.01 parts by weight of sodium persulfate and 0.02 parts by weight of sodium bisulfate were dissolved in 90 parts by weight of a 60 weight % zinc chloride aqueous solution to obtain 10 weight % of a monomer solution, and polymerization was conducted to produce a copolymer (molecular weight: 100,000). The copolymer was spun into a fiber, and the fiber was washed with water and then stretched as in Example 1. Then, this fiber was subjected to preoxidation for 150 minutes at 260° C. in air. The resulting preoxidized fibers contained 10.8 weight % of bonded oxygen. Subsequently, the preoxidized fibers were immersed for 10 minutes in a 1 weight % phosphoric acid aqueous solution, followed by drying the fibers at 120° C. for 1 hour. The thus phosphoric acid-deposited, preoxidized fibers were treated in a nitrogen stream at 850° C. for 5 minutes, then at 1300° C. for 15 minutes to carbonize the fibers. The resulting carbon fibers contained 1,000 ppm of the zinc component and 1,100 ppm of the phosphorus component. The strength of the fibers was measured using the strand method, and was found to be 288 kg/mm$^2$, and the modulus of elasticity was found to be $24.0\times10^3$ kg/mm$^2$. When the thermal oxidation resistance was evaluated under the same conditions as described in Example 1, the weight reduction ratio of the fibers was determined to be 11.3%.

EXAMPLE 3

Preoxidized fibers produced as described in Example 2 were immersed for 1 minute in a 1 weight % boric acid aqueous solution, and carbonized in the same manner as described in Example 2. The thus-obtained carbon fibers contained 1,000 ppm of the zinc component and 1,500 ppm of the boron component. The strength of the fibers was measured using the strand method. and found to be 303 kg/mm$^2$, and the modulus of elasticity was found to be $24.5\times10^3$ kg/mm$^2$. When the thermal oxidation resistance of the carbon fibers was evaluated under the same conditions as described in Example 1, the weight reduction ratio of the fibers was 8.6%.

COMPARATIVE EXAMPLE 1

Preoxidized fibers produced as described in Example 2 were carbonized in the same manner as described in Example 2 without treatment with the phosphoric acid aqueous solution. The resulting carbon fibers contained 1,100 ppm of the zinc component, with no phosphorus component nor boron component being detected. The strength was measured and found to be 285 kg/mm$^2$ using the strand method, and the modulus of elasticity was found to be $23.8\times10^3$ kg/mm$^2$. When the thermal oxidation resistance was evaluated under the same conditions as described in Example 1, the weight reduction ratio was as high as 57.5%, although the fiber shape was retained.

EXAMPLE 4

Carbon fibers produced as described in Comparative Example 1 were immersed for 10 minutes in an aqueous solution containing 0.5 weight % of phosphoric acid and 0.5 weight % of boric acid. Then, the fibers were dried for 1 hour at 120° C. The thus treated carbon fibers contained 1,100 ppm of the zinc component, 900 ppm of the phosphorus component and 600 ppm of the boron component. When the thermal oxidation resistance was evaluated under the same conditions as described in Example 1, the weight reduction ratio of the fibers was 9.5%.

EXAMPLE 5

9.6 parts by weight of acrylonitrile, 0.3 parts by weight of methyl acrylate, 0.1 parts by weight of sodium allylsulfonate and 0.01 parts by weight of sodium persulfate and 0.02 parts by weight of sodium bisulfate were dissolved in 90 parts by weight of a 60 weight % zinc chloride aqueous solution to obtain 10 weight % of a monomer solution, and polymerization was conducted to produce a copolymer. The molecular weight of the polymer was 90,000. Subsequently, the copolymer was spun into a fiber. The thus-obtained coagulated acrylic fibers were immersed in a 5 weight % calcium chloride aqueous solution for 10 minutes, followed by washing with water and stretching (as described in Example 1) to obtain a treated fiber. The treated fiber was immersed in a 1 weight % phosphoric acid aqueous solution for 1 minute and dried at 120° C. for 30 minutes. The thus treated acrylic fiber was preoxidized and carbonized in the same manner as in Example 1 to obtain carbon fibers. The thus-obtained carbon fibers contained 800 ppm of the calcium component and 700 ppm of the phosphorus component, with sodium and potassium being undetected.

The fiber performance characteristics of the carbon fibers were measured according to the strand method. The strength of the fibers was found to be 285 kg/mm$^2$, and the modulus of elasticity was found to be $23.8\times10^3$ kg/mm$^2$. The weight reduction ratio of the fibers, which was determined in the same manner as in Example 1, was 8.2%.

While the invention has been described in detail and with reference to specific embodiments thereof, it will be apparent to one skilled in the art that various changes and modifications can be made therein without departing from the spirit and scope thereof.

What is claimed is:

1. A carbon fiber derived from an acrylic fiber containing (1) 50 ppm to 5100 ppm of a phosphorus component, as phosphorus, a boron component, as boron, or a mixture thereof, and (2) 100 ppm or more of a zinc component, as zinc, a calcium component, as calcium, or a mixture thereof.

2. The carbon fiber as described in claim 1, wherein said carbon fiber has a weight reduction ratio of not more than 20% upon standing for 3 hours in air at 500° C.

3. A process for producing a carbon fiber as described in claim 1, which comprises producing an acrylonitrile polymer from a monomer solution containing at least acrylonitrile, spinning the acrylonitrile polymer to produce an acrylonitrile fiber, preoxidizing the acrylonitrile fiber to produce a preoxidized fiber and then carbonizing the fiber to produce a carbon fiber and further incorporating or depositing (1) a phosphorus compound, a boron compound or a mixture thereof and (2) a zinc compound, a calcium compound of a mixture thereof in or on the acrylic fiber, the preoxidized fiber or the carbon fiber during the process such that the carbon fiber ultimately contains 50 ppm to 5100 ppm of a phosphorus component, a boron component or a mixture thereof and 100 ppm or more of a zinc component, a calcium component or a mixture thereof.

4. The process for producing the carbon fiber as described in claim 3, wherein said compounds are incorporated in or deposited on the acrylic fiber, the preoxidized fiber or the carbon fiber in a single step or in two or more steps during the process.

5. The process for producing the carbon fiber as described in claim 3, wherein at least one of said phosphorus compound and/or said boron compound (1) and said zinc compound and/or said calcium compound (2) is incorporated into the monomer solution, or into a solution of the acrylonitrile polymer before pinning the acrylonitrile polymer to produce the acrylonitrile fiber, and the other of said phosphorus compound and/or said boron compound (1) and said zinc compound and/or said calcium compound (2) is incorporated in or deposited on the acrylonitrile fiber during the spinning of the acrylonitrile fiber, during a washing step or after washing but prior to the preoxidizing of the acrylonitrile fiber.

6. The process for producing the carbon fiber as described in claim 3, wherein at least one of said phosphorus compound and/or said boron compound (1) and said zinc compound and/or said calcium compound (2) is incorporated in or deposited on the acrylic fiber during or after the production of the acrylonitrile fiber and before the preoxidation of said acrylic fiber and, after the preoxidation, the other of said phosphorus compound and/or said boron compound (1) and said zinc compound and/or said calcium compound (2) is deposited on the fiber, followed by the carbonization.

7. The process for producing the carbon fiber as described in claim 3, wherein at least one of said phosphorus compound and/or said boron compound (1) and said zinc compound and/or said calcium compound (2) is incorporated in or deposited on the acrylonitrile fiber during or after the production of the acrylonitrile fiber but before said preoxidation and the other of said phosphorus compound and/or said boron compound (1) and said zinc compound and/or said calcium compound (2) is deposited on the carbon fiber after the carbonization.

8. The process for producing the carbon fiber as described in claim 3, wherein the incorporation or deposition is carried out using a mixture containing all necessary compounds at any step during or after production of the carbon fiber.

9. The process for producing the carbon fiber as described in claim 3, wherein said phosphorus compound is a phosphoric acid, a phosphoric acid salt of a metal of group Ib, IIa, IIb, IIIa, IIIb, IVa, IVb, Va, Vb, VIa, VIb, VIIb or VIII in the Periodic Table or a phosphoric ester.

10. The process for producing the carbon fiber as described in claim 3, wherein said boron compound is a boric acid, a boric acid salt of a metal of group Ib, IIa, IIb, IIIa, IIIb, IVa, IVb, Va, Vb, VIa, VIb, VIIb or VIII in the Periodic Table or a boric ester.

11. The process for producing the carbon fiber as described in claim 3, wherein said zinc compound is zinc chloride, zinc oxide, zinc sulfate, zinc hydroxide, zinc carbonate, zinc bromide or zinc iodide.

12. The process for producing the carbon fiber as described in claim 3, wherein said calcium compound is calcium oxide, calcium peroxide, calcium hydroxide, calcium chloride, calcium sulfate, calcium nitrate, calcium iodide or calcium bromide.

13. The process for producing the carbon fiber as described in claim 3, wherein said acrylonitrile fiber is produced continuously by preparing a reaction mixture containing acrylonitrile and a polymerization catalyst dissolved in an aqueous solution of zinc chloride, polymerizing the acrylonitrile to produce an acrylonitrile polymer and spinning the acrylonitrile polymer.

14. The process for producing the carbon fiber as described in claim 3, wherein ssaid preoxidation is in an oxidizing atmosphere at about 200° to 300° C. and said carbonization is in an inert atmosphere at about 500° to about 1500° C.

15. The carbon fiber of claim 1, which has improved thermal oxidation resistance.

16. The carbon fiber of claim 15, wherein sodium and potassium are present in an amount less than 100 ppm.

17. The carbon fiber of claim 16, which is produced by a preoxidation followed by a carbonization of the acrylic fiber, wherein the preoxidation provides an intermediate product with about 8 to about 15 weight percent of bonded oxygen.

18. The carbon fiber of claim 1, wherein said component (1) and said component (2) are introduced via an aqueous or organic solution or dispersion of said component (1) and said component (2).

19. The carbon fiber of claim 1, wherein said component (1) is said phosphorus component.

20. The carbon fiber of claim 1, wherein said component (1) is said boron component.

21. The carbon fiber of claim 1, wherein said component (2) is said zinc component.

22. The carbon fiber of claim 1, wherein said component (2) is said calcium component.

23. The carbon fiber of claim 1, wherein said component (1) is present in an amount of 50 to 1000 ppm.

24. The carbon fiber of claim 23, wherein said component (2) is present in an amount of 100–5000 ppm.

25. The process of claim 3, which provides a carbon fiber of improved thermal oxidation resistance.

26. The process of claim 25, wherein sodium and potassium are present in said carbon fiber in an amount of less than 100 ppm.

27. The process of claim 26, wherein said component (1) and said component (2) are incorporated or deposited as an aqueous or organic solution or dispersion thereof.

28. The process of claim 3, wherein said component (1) is phosphorus.

29. The process of claim 3, wherein said component (1) is boron.

30. The process of claim 3, wherein said component (2) is zinc.

31. The process of claim 3, wherein said component (2) is calcium.

32. The process of claim 3, wherein said component (1) is present in an amount of 50 to 1000 ppm.

33. The process of claim 32, wherein said component (2) is present in an amount of 100–5000 ppm.

* * * * *